United States Patent [19]

Vigh

[11] Patent Number: 4,504,986

[45] Date of Patent: Mar. 19, 1985

[54] SINK MOUNTING

[75] Inventor: James A. Vigh, North Olmsted, Ohio

[73] Assignee: Stanadyne, Inc., Windsor, Conn.

[21] Appl. No.: 508,346

[22] Filed: Jun. 29, 1983

Related U.S. Application Data

[63] Continuation-in-part of Ser. No. 405,394, Aug. 5, 1982.

[51] Int. Cl.[3] ..... E03C 1/18

[52] U.S. Cl. ..... 4/633; 4/634

[58] Field of Search ..... 4/619, 630–636, 4/643, 648, 649, 660; 312/140.4, 140.3, 140.1, 228; 248/500, 154, DIG. 6, 27.1, 27.3

[56] References Cited

U.S. PATENT DOCUMENTS 3,034,145 5/1962 Lyon ..... 4/635

3,583,002 6/1971 Roberts ..... 4/636

3,680,152 8/1972 Farrell ..... 4/633

*Primary Examiner*—Henry K. Artis

*Attorney, Agent, or Firm*—Kinzer, Plyer, Dorn & McEachran

[57] ABSTRACT

A sink mounting for top installation of a sink, for example a kitchen sink, includes a plurality of brackets which may be adjustably mounted to the underside of the sink deck through the sink opening. The brackets each include a locking portion having a concave locking surface which is formed and adapted to interlock with a channel positioned on the underside of the sink. When the sink is pushed through the sink opening, the channels have flexible hook portions which yield so as to permit the sink to be moved through the opening, but provide an interlock with the concave locking surfaces once it is firmly positioned upon the sink deck.

5 Claims, 11 Drawing Figures

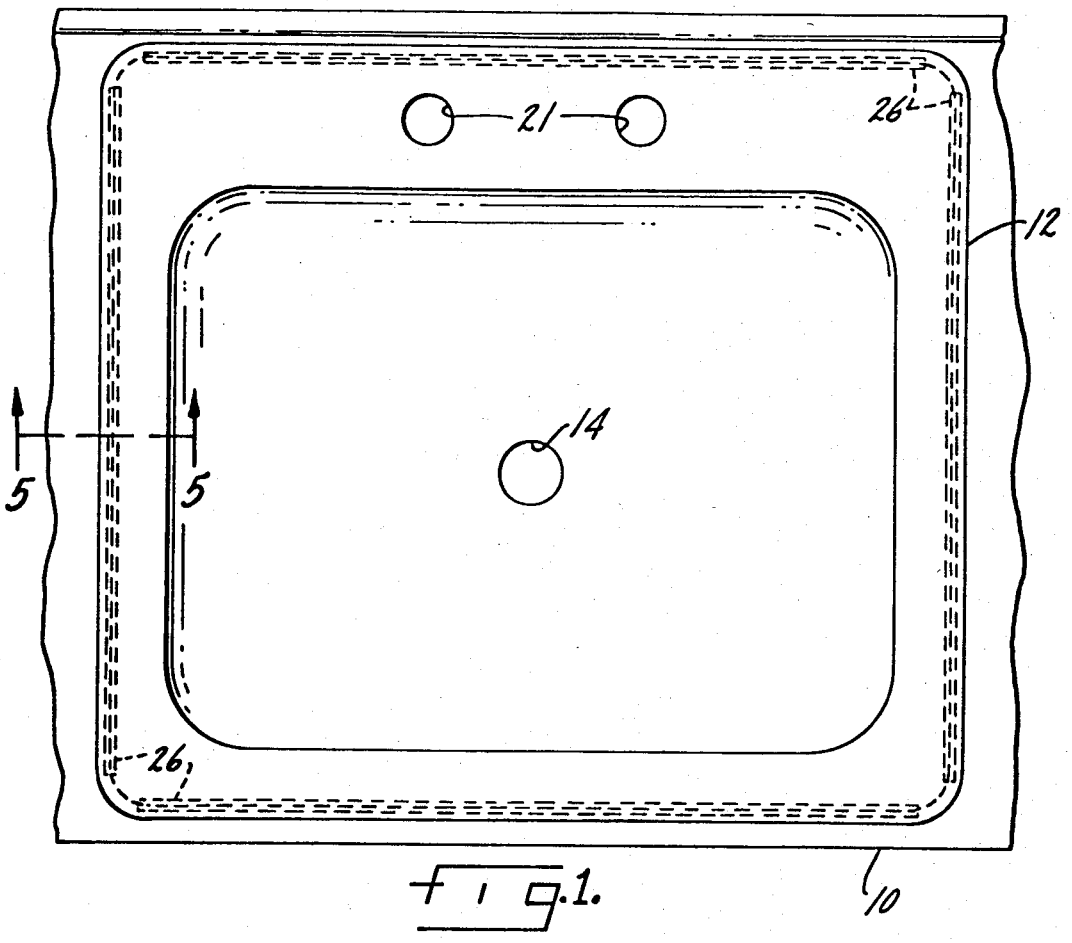
fig.1.
fig.2.
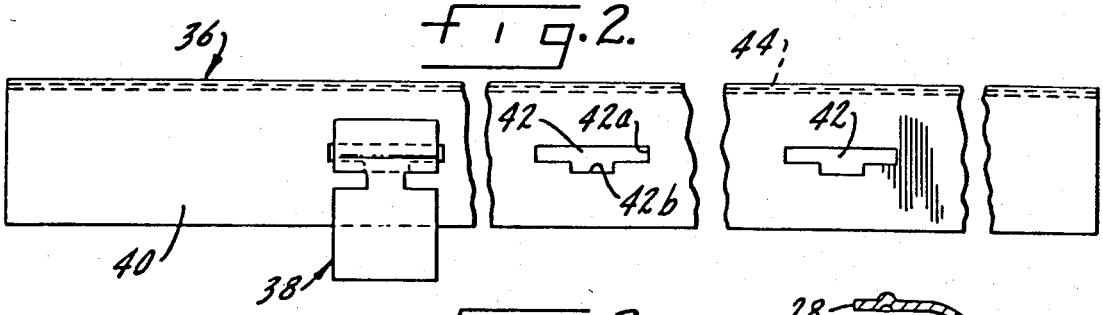
fig.3.
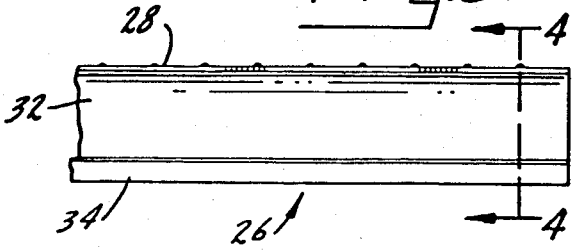
fig.4.
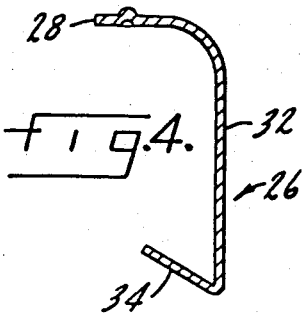

Fig. 5.
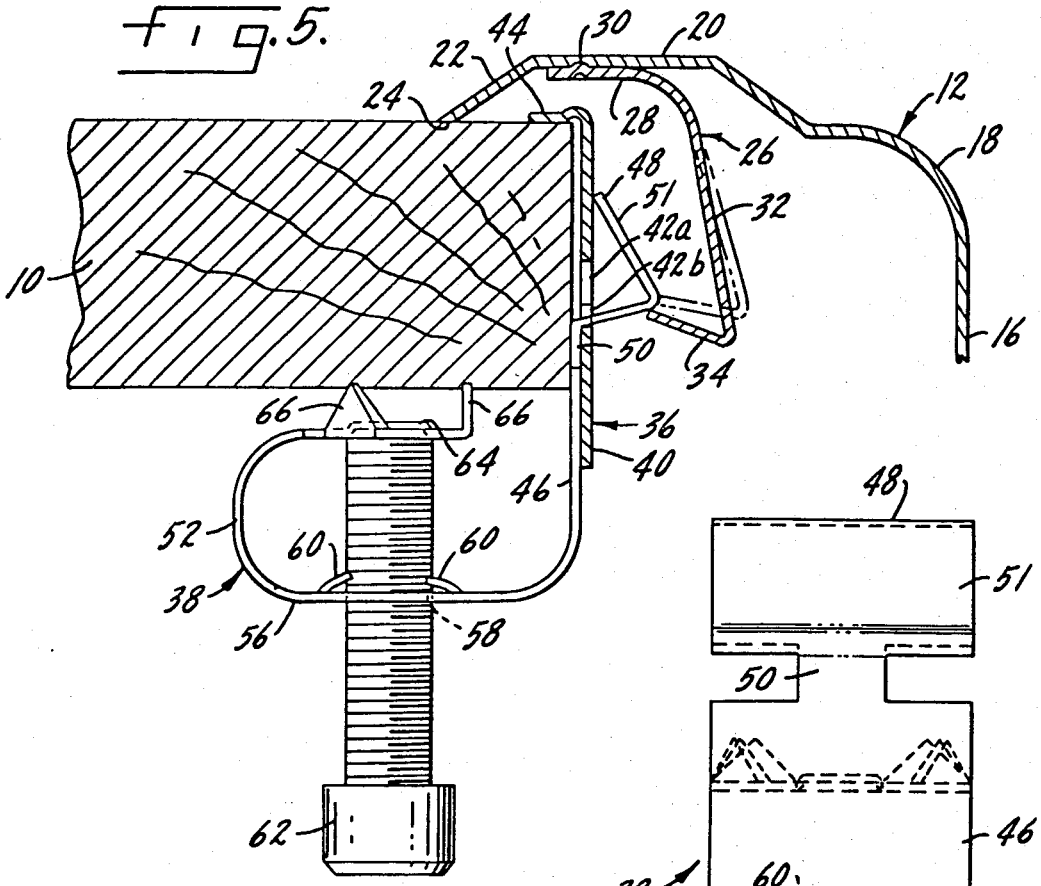
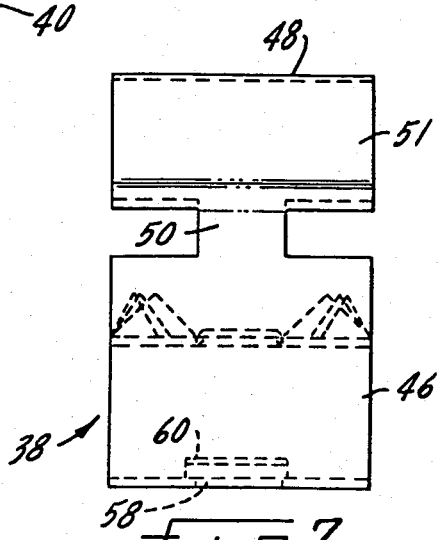
Fig. 7.
Fig. 6.
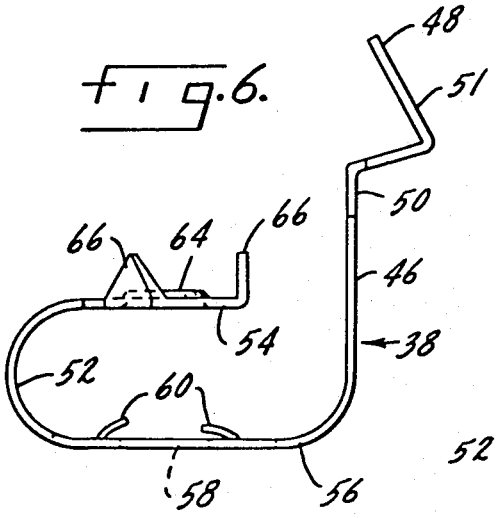
Fig. 8.
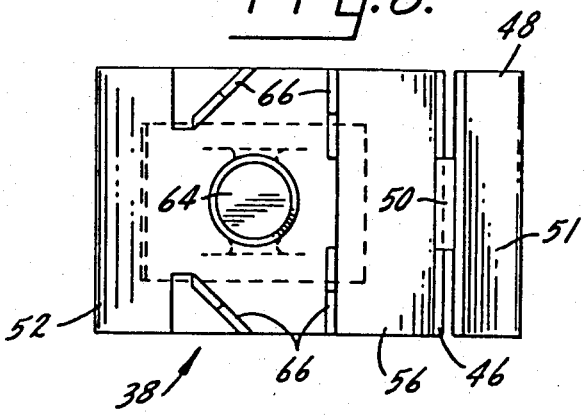

SINK MOUNTING

SUMMARY OF THE INVENTION

This application is a continuation-in-part of copending application Ser. No. 405,394, filed Aug. 5, 1982.

The present invention relates to sinks and in particular to a means for mounting a kitchen sink from the top, through the conventional sink top opening.

A primary purpose of the present invention is a means for mounting a sink, for example a kitchen sink, from the top, eliminating the conventional installation from beneath the sink.

Another purpose is a sink installation which permits installation of the sink from above the sink top opening and which includes a plurality of brackets which may be spaced about the sink top opening and which have a positive interlock with depending channels attached to the underside of the sink.

Another purpose is a sink attachment of the type described which includes concave locking surfaces forming a positive interlock with flexible hooks attached to the sink.

Another purpose is a sink attachment of the type described which is adaptable for use in mounting various sizes, shapes and types of sinks.

Other purposes will appear in the ensuing specification, drawings and claims.

BRIEF DESCRIPTION OF THE DRAWINGS

The invention is illustrated diagrammatically in the following drawings wherein:

FIG. 1 is a top plan view of a sink installation of the type disclosed herein, FIG. 2 is a side view, on an enlarged scale, illustrating the bracket construction which is attached to the sink deck sides, FIG. 3 is an enlarged partial side view of the sink channel, FIG. 4 is an enlarged section along plane 4—4 of FIG. 3, FIG. 5 is an enlarged section along plane 5—5 of FIG. 1, FIG. 6 is an enlarged side view of the bracket lower clip, FIG. 7 is an enlarged front view of the lower clip, FIG. 8 is an enlarged top view of the lower clip.

DESCRIPTION OF THE PREFERRED EMBODIMENT

Figure 9:
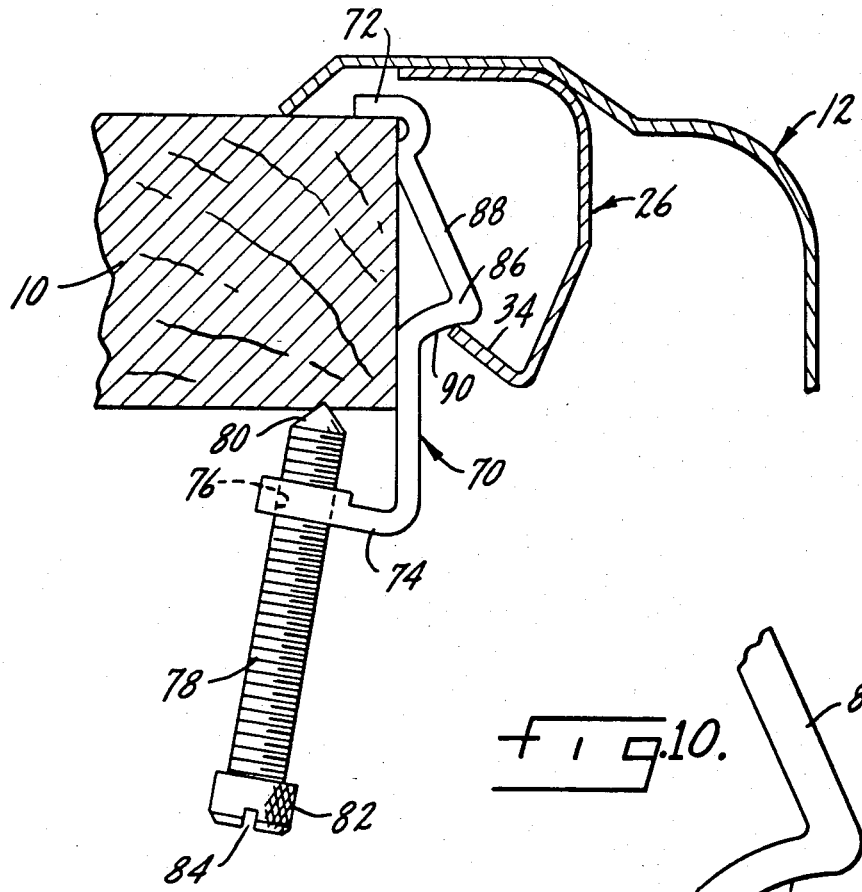
FIG. 9 is an enlarged section illustrating a modified bracket.

The present invention is specifically directed to the installation of sinks and has application to kitchen and lavatory sinks in the home. The principal objective of the invention is to provide a sink installation in which the sink itself may be installed from the top of the sink deck, eliminating the necessity of the sink installer from having to go beneath the sink to tighten or fasten the sink into its correct location. Although it may be necessary to make plumbing connections to the sink once installed, it is not necessary for the installer to attach the sink from beneath the sink deck. The entire installation of the sink, including the support and interlocking brackets, may be done from above the sink top opening.

In FIG. 1, a sink deck is indicated at 10 and will customarily extend peripherally about all four sides of the sink. The sink may take on any size or shape and what is shown herein is the customary generally rectangular sink conventionally found in home kitchens. The sink itself is indicated at 12 and has a drain hole 14. As illustrated in FIG. 5, the sink may have a bowl portion 16 which merges into a curved area 18, which in turn merges with a top flat area 20. Peripherally about the top flat area 20 is a slanted portion 22, the lower edge 24 of which is in contact with the upper surface of sink deck 10. The flat area 20 extends peripherally about the bowl and may have a slightly widened area on one side which will accomodate the faucet and spout escutcheon which will overlie water connection openings 21.

Attached to the underside of flat area 20 is a generally L-shaped channel 26. There may be a plurality of such channels, one for each side, and the channels will extend substantially the entire length of each side, as shown in dotted lines in FIG. 1. Each channel includes an upper portion 28 which may be spot welded, as at 30, or otherwise attached to the underside of flat area 20. The channels each include a downwardly-extending leg 32 with the lower end of the leg being formed into a somewhat outwardly and upwardly-extending hook portion 34. The L-shaped channels are flexible in that they will spring to the full line position of FIG. 5 from the dotted line distorted position of FIG. 5 as the sink and the attached channels are pushed down through the sink top opening.

The brackets for attaching and permanently holding the sink in position are illustrated in FIGS. 2 and 5–8. There is a bracket extending along each side of the sink and the brackets will each include an upper clip 36 and a plurality of lower clips 38. The upper clips, as particularly illustrated in FIGS. 1 and 2, are generally coextensive with the L-shaped channels and each include a downwardly-extending leg 40 having a plurality of openings 42 and a support portion 44 which rests on top of the sink deck 10, as particularly illustrated in FIG. 5. Each of openings 42 has a rectangular portion **42*a* and a somewhat slotlike area 42*b* to accomodate lower clips 38**.

Each of lower clips 38 includes an upper arm 46 which terminates in a projection 48, which projection will extend through an opening 42 in upper clip 36. Each of projections 48 have a portion 50 of somewhat narrower cross section so that the portion 50 may be positioned within slot **42*b* of openings 42. Portions 51 of each of the projections have a wider cross section and are of a size and shape to extend through the larger portion of openings 42, indicated at 42*a*. FIG. 2** illustrates the assembly of the upper and lower clips.

Lower clips 38 further have a U-shaped area or section 52 having an upper leg 54 and a lower leg 56. Lower leg 56 has an opening 58 with inwardly-directed tabs 60 thereabove, which tabs form a Tinnerman type of nut to accomodate a threaded bolt 62. Bolt 62 extends upwardly into contact with the underside of upper leg 54 and is positioned within a projection 64 in leg 54. Adjacent projection 64 are a plurality of upwardly-extending taps or projections 66 which are positioned to be forced into the underside of deck 10 during installation.

The first step in the installation procedure is to loosely position the various lower clips within each upper clip 36, there being one such clip combination for each side of the sink. The upper and lower clip combination is then inserted through the sink top opening from above, with upper clip portion 44 being positioned on the top of the deck adjacent the periphery of the sink opening. Each lower clip 38 has its leg 46 positioned against the side of the sink top opening as in FIG. 5. The installer then turns bolt 62 until projections or tabs 66 extend into the bottom of the deck. By turning the bolt, the upper leg or arm of the U-shaped portion 52 will be moved upwardly until the projections 66 are embedded within the bottom of the sink deck. Each of the clip assemblies or brackets is firmly attached to a side of the sink opening.

After all of the clip assemblies have been properly positioned, the installer positions the sink above the sink opening and pushes the sink downwardly. As the sink drops down, the lower end of the L-shaped channels will be flexed inwardly as the hook portions 34 contact projections 48 of the lower clips. The channels will be bent inwardly until the hooks have passed down beyond projections 48 of the lower clip, after which the hooks will spring back to the position illustrated in FIG. 5.

The relationship between the arrangements of the upper and lower clips and the size and shape of channels 26 is such that when the sink is completely installed and firmly seated upon the deck, the hook portions 34 will be beneath projections 48 of the lower clips. This will provide a strong downward bias upon the sink itself to thus firmly hold it in position. Accordingly, not only do the clip and channel combinations provide a means for installing the sink from above, but they provide a downward bias upon the sink to firmly and properly hold it in position.

Of advantage is the fact that no screws or bolts need to be used to attach the sink from beneath the sink deck and, in fact, the entire installation need only take a few minutes, long enough for the various bolts 62 to be used to fasten the clip assemblies on all sides of the sink top opening.

Figure 10:
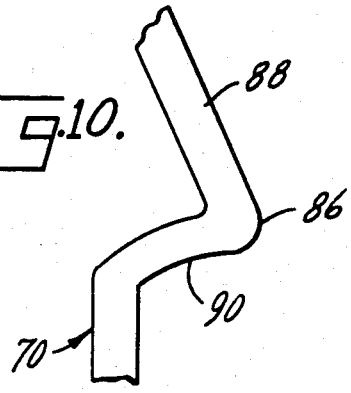
FIG. 10 is a further enlargement of a portion of the bracket of FIG. 9.
Figure 11:
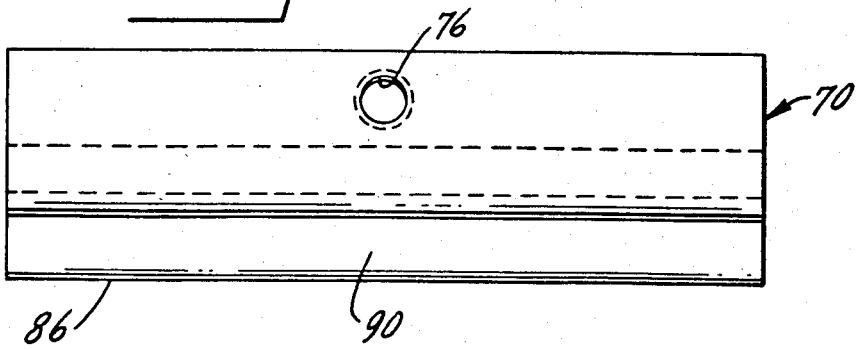
FIG. 11 is a bottom plan view of the bracket of FIGS. 9 and 10.

FIGS. 9, 10 and 11 show a modified embodiment in which each bracket is of a unitary construction rather than having separate clips 36 and 38. Each bracket 70 has an upper portion 72 which will overlie the edge of the sink deck adjacent the opening and a lower outwardly-extending portion 74. A threaded boss 76 is formed in portion 74 to position a fastener 78 having a sharpened end 80. Fastener 78 may have a knurled head 82 for hand gripping, as well as a tool slot 84. In assembly, the fastener will be turned until its sharpened nose penetrates the sink deck bottom to firmly hold each bracket in place.

Intermediate bracket areas 72 and 74 is an integral inwardly-extending projection 86 having an upper surface 88 and a lower locking surface 90. As particularly shown in FIG. 10, surface 90 is concave, not flat, thereby forming a more positive interlock with hooks 34 of channels 26.

When the sink of this embodiment is installed, the lower end of the L-shaped channels will be flexed inwardly to permit hook portions 34 to pass over the projection on the brackets. Once past the nose of the projections, the hook portions will outwardly return to a position beneath locking surfaces 90. The outward bias of the hook portions will urge each element into a positive interlock with the concave locking surfaces. The concavity of the locking surfaces makes it highly unlikely for the brackets and channels to become accidentally disconnected. Each hook element will be under tension in the interlocked position and will extend up into the shallow concavity of its locking surface.

Whereas the preferred form of the invention has been shown and described herein, it should be realized that there may be many modifications, substitutions and alterations thereto.

The embodiments of the invention in which an exclusive property or privilege is claimed are defined as follows:

1. A sink mounting for top installation of a sink through a sink top opening including:

brackets for adjustable mounting to a deck surrounding, at least in part, a sink top opening, said brackets being mountable through the sink top opening, said brackets being mounted at a plurality of spaced locations about the sink top opening and having locking portions thereon which include inwardly-directed projections with a lower locking surface thereon, each bracket including an upper clip and a lower clip attached thereto, said upper clip having a support portion resting upon the deck adjacent the sink top opening, with the lower clip having means for adjustably fastening it to the underside of the deck adjacent the sink top opening, a sink having channel means on the underside thereof and adjacent the periphery thereof, said channel means including a flexible hook formed to interlock with said bracket locking portion locking surface by extending into locking contact thereagainst when the sink is inserted through the sink top opening.

2. The sink mounting of claim 1 further characterized in that said upper clip has a length substantially the same as the length of a side of the sink top opening, with there being a plurality of openings in each upper clip, with the lower clips extending through said openings.

3. The sink mounting of claim 2 further characterized in that said lower clip includes the bracket projection, which bracket projections extend through the openings in the upper clip.

4. The sink mounting of claim 3 further characterized in that each lower clip includes a threaded member for adjustably moving a portion of said lower clip into attachment to the underside of the sink deck.

5. The sink mounting of claim 4 further characterized in that each lower clip includes a U-shaped area, with said threaded member extending through one leg on said U-shaped area and, upon rotation, being effective to move the other leg of the U-shaped area into attachment with the underside of the sink deck.

* * * * *